US005471700A

United States Patent [19]

Pereira

[11] Patent Number: 5,471,700

[45] Date of Patent: Dec. 5, 1995

[54] HANDLE FOR GRILL CLEANING TOOLS

[76] Inventor: Camilo Pereira, 633 NE. 167th St. #701, North Miami Beach, Fla. 33162

[21] Appl. No.: 351,940

[22] Filed: Dec. 8, 1994

[51] Int. Cl.[6] ..... A46B 5/02; A47L 13/022

[52] U.S. Cl. ..... 15/160; 15/236.01; 15/236.02; 15/143.1; 81/489

[58] Field of Search ..... 15/236.01, 236.02, 15/236.05, 236.07, 160, 159.1, 143.1, 145; 81/489; 16/110 R, 114 R

[56] References Cited

U.S. PATENT DOCUMENTS 4,813,458 3/1989 Jacobucci ..... 15/236.02
4,962,561 10/1990 Hamilton ..... 15/236.02

FOREIGN PATENT DOCUMENTS 2277900 11/1994 United Kingdom ..... 15/236.01

*Primary Examiner*—Edward L. Roberts, Jr.
*Attorney, Agent, or Firm*—Robert M. Downey

[57] ABSTRACT

A handle includes a distal working head portion with a distal end and a distalmost splash guard, an intermediate gripping portion including an upstanding gripping member, and a proximal forearm embracing portion including a pair of opposite level rails extending upwardly at an angle from the gripping portion and diverging outwardly to an inverted U-shaped portion. The inverted U-shaped portion is sized to nest over the forearm of a user to apply downwardly directed forces on the distal end of the working head portion. A recess in the lower surface of the working head portion is structured to receive grill cleaning tools for removable attachment to the handle.

7 Claims, 1 Drawing Sheet

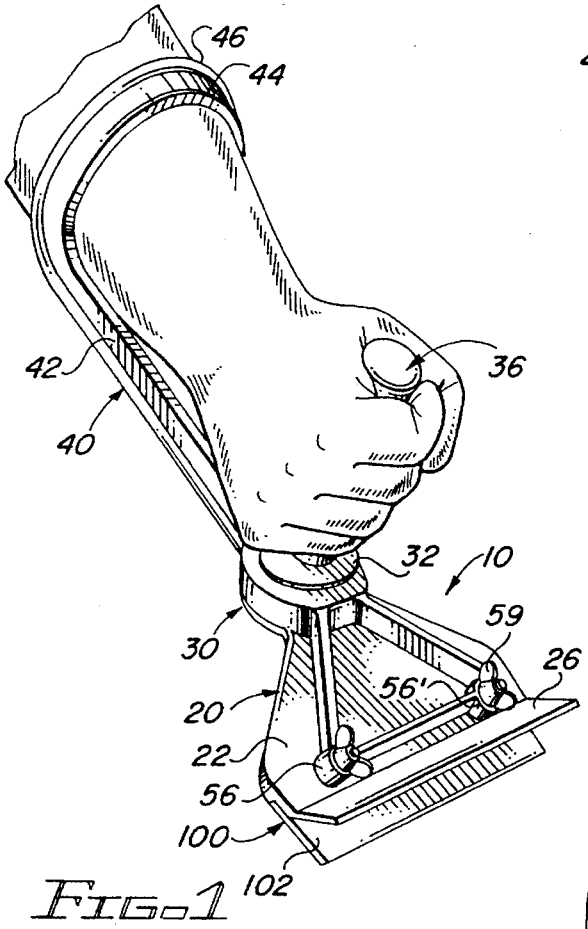
FIG. 1
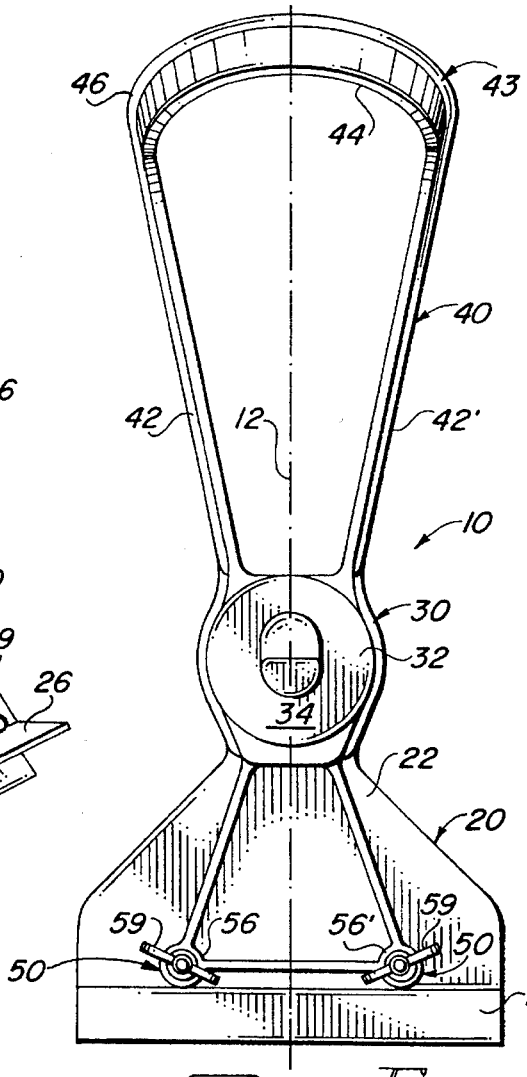
FIG. 2
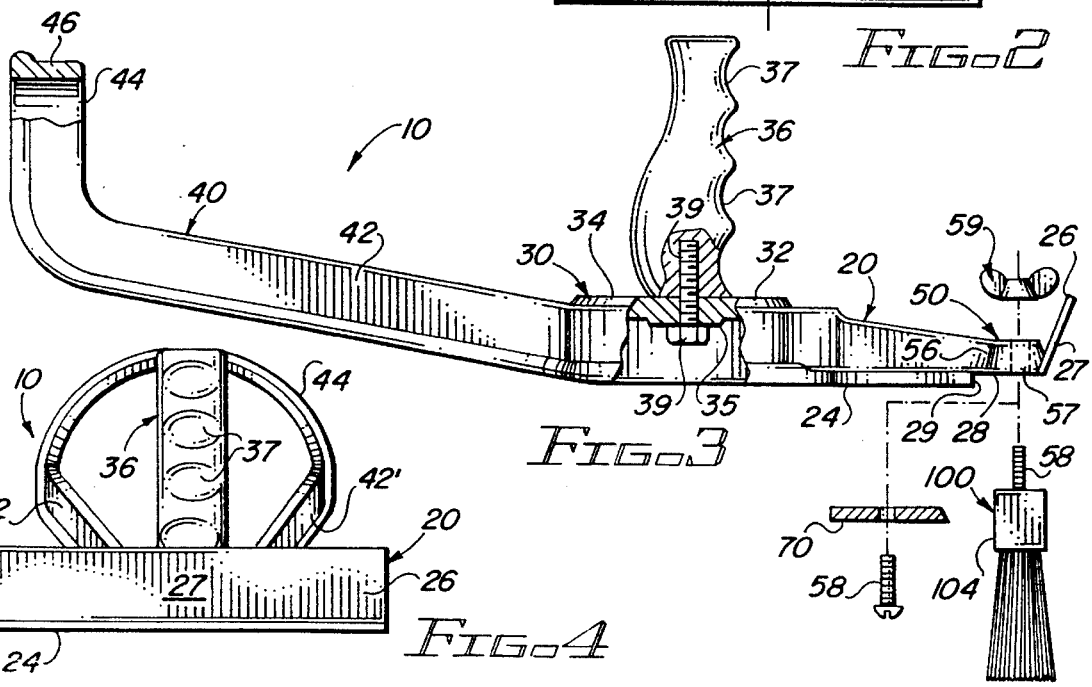
FIG. 3
FIG. 4

HANDLE FOR GRILL CLEANING TOOLS

BACKGROUND OF THE INVENTION

1. Field of the Invention

The present invention relates to a handle for tools used to clean cooking grills, and particularly to a handle having a forearm embracing portion and an upstanding griping portion structured to enable the user to apply a downwardly directed force against the grill surface while protecting the user's hand from contact with a hot grill.

2. Description the Related Art

The use of grills for cooking a wide variety of food items is widespread especially in the restaurant industry. When cooking on a grill especially in a busy restaurant, it is necessary to clean the grill frequently so that food being cooked is properly prepared. This helps to maintain the flavor of the food, while preventing exposure to excess grease and accumulated burned particles from previously cooked foods. Due to the necessity to regularly clean a grill, between cooking of different food items, and because grease and other particulate is easier to remove from the grill at hotter temperatures, grills are usually cleaned when they are hot.

There are various tools which are used for grill cleaning, the most common being a scraper or blade and a grill brush. The handles used with these tools are similar to handles normally found on other scraping tools and cooking utensils, extending straight from the blade or brush and including an area for grasping by a hand. While the grill cleaning tools in the related art are somewhat effective and useful for their extended purpose, the structure and design of the handles provides no protection against contact of the user's hand with a hot grill. And because grills and the cleaning tools are often covered with grease and other slippery substances, many cooks have been burned due to their hands slipping off of the handle and contacting the hot grill. Additionally, the handle structures in the related art fail to provide a means to generate sufficient leverage in order to apply a substantial force on the tool against the grill surface to scrape off stubborn accumulated substances. Thus, cooks are often forced to use two hands when grasping the grill cleaning tool handle in order to generate sufficient leverage while preventing their hand from slipping off of the handle and contacting the grill.

Accordingly, there is a need in the grill cleaning tool art for a handle which is structured to protect the user's hand from contact with hot grills, while requiring the use of only one hand to generate sufficient leverage against the grill surface.

SUMMARY OF THE INVENTION

The present invention is directed to a handle structured for attachment of various grill cleaning tools therewith. The handle includes a distal working head portion having a distal end and a distalmost splash guard extending across the distal end. The handle further includes an intermediate gripping portion having an upstanding gripping member contoured to be gripped by the fingers of a user's hand, and a proximal forearm embracing portion. The forearm embracing portion includes a pair of opposite lever rails extending outwardly at an angle from the gripping portion and diverging outwardly to an inverted U-shaped portion. The inverted U-shaped portion is sized and configured to nest over the forearm of a user so that a downwardly directed force can be applied on the distal end of the working head portion, such that a tool attached thereto is forced against the grill surface being cleaned.

A recess in the lower surface of the working head portion is structured to receive various grill cleaning tools, including scrapper blades and brushes, for removable attachment to the handle.

With the forgoing in mind, it is a primary object of the present invention to provide a handle adapted for removable attachment of grill cleaning tools thereto, wherein the handle is specifically structured to protect the user's hand from contact with a hot grill surface while requiring the use of only one hand.

It is a further object of the present invention to provide a handle specifically structured for removable attachment of various grill cleaning tools thereto, the handle including leverage means specifically structured to apply sufficient force on the grill cleaning tool against the grill surface using only one hand.

It is still a further object of the present invention to provide a handle for grill cleaning tools including a splash guard to protect the user's hand.

It is still a further object of the present invention to provide a handle for grill cleaning tools which is formed of a rigid, high strength material providing durability for use in commercial environments such as restaurants.

These and other objects and advantages of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which:

FIG. 1 is a top perspective view the handle of the present invention shown in use with a scrapping tool attached to the working head portion of the handle.

FIG. 2 is a top plan view of the handle of the present invention.

FIG. 3 is an exploded side elevational view, in partial section, of the handle showing removable attachment of a grill brush to the lower surface of the working head portion.

FIG. 4 is a distal end elevational view of the handle of FIG. 2.

Like reference numerals refer to like parts throughout the several views of the drawings.

DETAILED DESCRIPTION OF THE PREFERRED EMBODIMENT

Referring to the several views of the drawings, there is generally illustrated the handle 10 of the present invention including a longitudinal centerline 12, a distal working head portion 20, an intermediate gripping portion 30 and a proximal forearm embracing portion 40.

The working head portion 20 includes an upper surface 22 and a lower surface 24 and a distalmost splash guard 26 extending along the length of the distal end of the working head portion to define a distal face 27. A recess 28 in the lower surface of the working head portion defines an abutment shoulder 29 extending across the working head portion. The recess 28 is specifically sized and configured to receive a portion of a tool 100, such as a blade 102 or brush 104, in attached, fixed engagement on the lower surface 24 (see FIGS. 1 and 3).

The gripping portion 30 includes a generally circular plate 32 having a top surface 34 and a bottom surface 35. An upstanding member 36 attaches to the top surface 34 with a threaded bolt or screw 39 received through the bottom surface 35 and upwardly for threaded engagement within the upstanding member 36, until the head of the bolt 39 engages the bottom surface 35. The upstanding member 36 includes contoured grooves 37 specifically shaped and configured for gripping by the fingers of a user's hand. A remainder of the upstanding member 36 is further contoured to conform with a user's hand so that a firm grip can be achieved in order to apply forces generally parallel to the centerline 12.

Attachment means 50 on the working head portion 20 facilitate removable attachment of the grill cleaning tool 100 within the recess of the head portion in engagement with the abutment shoulder 29. As best seen in FIGS. 2 and 3, the attachment means 50, in a preferred embodiment, includes a pair of spaced hubs 56, 56', with each of the hubs including a bore 57 extending axially there through. A screw 58, for attaching the tool 100 to the lower surface 24 of the working head portion 20, extends axially through the bore 57 and out through the top thereof for threaded receipt of a wingnut 59. The screws 58 may be a part of the tool, as seen on the brush 104, or they may be separate and thus pass through apertures formed on the tool, such as in the case of the blade 102. Depending on the size of the tool portion which fits within the recess, an insert plate 70 may be necessary to abut against the shoulder 29 of the recess 28.

The proximal forearm embracing portion 40 includes a pair of opposite lever rails 42, 42' extending proximally from the gripping portion and upwardly at an angle of approximately 10 degrees relative to the upper 22 and lower 24 surfaces of the working head portion 20. The lever rails 42, 42' diverge outwardly, from the gripping portion 30, with respect to one another, to a proximal end zone 43 comprising an inverted U-shaped portion 44. The U-shaped portion 44 is specifically sized and configured to nest over the forearm of a user so that a tilting force can be applied in order to exert downwardly directed forces on the distal end of the working head portion and the attached tool. In this manner, the tool can be applied to the surface of the grill with a sufficient force in order to remove stubborn accumulated substances. An enlarged rim 46 extends along the length of each of the opposite lever rails 42, 42' and the inverted U-shaped portion 44 so a to provide increased rigidity to the forearm embracing portion 40.

While the invention has been shown and described in what is considered to be a practical and preferred embodiment, it is recognized that departures may be made within the spirit and scope of the following claims which, therefore, should not be limited except within the Doctrine of Equivalents.

Now that the invention has been described,

What is claimed is:

1. A handle for a tool, said handle being of rigid material and having a longitudinal centerline and comprising:

a distal working head portion having a distal end, an intermediate gripping portion, and a proximal forearm embracing portion, said portions being symmetrical with respect to the longitudinal centerline of the handle, said gripping portion including:

a base between said working head portion and said forearm embracing portion and including a top surface, an upstanding member extending upwardly from said top surface and contoured to be gripped by the fingers and hand of a user to apply forces generally parallel to the centerline, said working head portion including:

an upper surface and a lower surface, a distalmost splash guard extending upwardly from the upper surface across the working head portion, said lower surface of said working head portion including a recess extending from the distal most end proximally and across the head portion defining an abutment shoulder, said recess being sized and configured to receive a portion of a tool, attachment means carried on the working head portion for removably attaching the tool to the head portion in the recess and in engagement with the abutment shoulder, said forearm embracing portion including:

a pair of opposite lever rails extending proximally from the gripping portion upwardly at an angle relative to said upper and lower surface of said working head portion and said lever rails diverging outwardly with respect to one another to a proximal end zone, said proximal end zone including an inverted U-shaped portion sized to nest over the arm of a user to apply a tilting force in order to exert downwardly directed forces on the distal end of the working head portion and the tool attached thereto when in use.

2. The handle as set forth in claim 1 including a blade removable attachable to the working head portion and including means to engage the attachment means.

3. The handle as set forth in claim 1 including a scrapping tool removably attachable to the working head portion and including means to engage the attachment means.

4. The handle as set forth in claim 3 wherein said scraping tool extends across the distal end of the working head portion when attached thereto.

5. The handle as set forth in claim 1 including a brush removably attachable to said working head portion.

6. The handle as set forth in claim 1 including rigidifying means along a lower surface of said proximal forearm embracing portion including along a lower surface of said opposite lever rails and said inverted U-shaped portion.

7. The handle as set forth in claim 1 wherein said attachment means comprises a pair of spaced hubs with a bore therethrough and screw and nut means therein structured and disposed to captivate and maintain the tool in said recess in said lower surface of said working head portion.

* * * * *